US009726165B2

(12) United States Patent
Gao

(10) Patent No.: US 9,726,165 B2
(45) Date of Patent: Aug. 8, 2017

(54) HIGH-PRESSURE AIR PUMP

(71) Applicant: NANTONG GUANGXING PNEUMATIC EQUIPMENT CO., LTD., Nantong, Jiangsu (CN)

(72) Inventor: Xuefeng Gao, Jiangsu (CN)

(73) Assignee: Nantong Guangxing Pneumatic Equipment Co., Ltd., Nantong (CN)

( * ) Notice: Subject to any disclaimer, the term of this patent is extended or adjusted under 35 U.S.C. 154(b) by 281 days.

(21) Appl. No.: 14/409,764

(22) PCT Filed: Mar. 28, 2014

(86) PCT No.: PCT/CN2014/074249

§ 371 (c)(1),
(2) Date: Dec. 19, 2014

(87) PCT Pub. No.: WO2015/109654

PCT Pub. Date: Jul. 30, 2015

(65) Prior Publication Data

US 2016/0265524 A1 Sep. 15, 2016

(30) Foreign Application Priority Data

Jan. 24, 2014 (CN) ..... 2014 1 0033449

(51) Int. Cl.
*F04B 39/16* (2006.01)
*F04B 25/00* (2006.01)
(Continued)

(52) U.S. Cl.
CPC ..... *F04B 39/16* (2013.01); *F04B 25/00* (2013.01); *F04B 25/04* (2013.01);
(Continued)

(58) Field of Classification Search
CPC .... F04B 39/0292; F04B 39/064; F04B 39/16; F04B 53/04; F04B 53/08; F04B 53/16; F04B 25/04; F16J 1/08
See application file for complete search history.

(56) References Cited

U.S. PATENT DOCUMENTS 1,450,032 A * 3/1923 Gardner ..... F04B 25/005 165/121
2007/0221056 A1 9/2007 Kutella
2012/0282114 A1 11/2012 Cannata

FOREIGN PATENT DOCUMENTS

CN 1067295 12/1992
CN 2584859 11/2003
(Continued)

OTHER PUBLICATIONS

Written Opinion or the International Searching Authority, mailed Oct. 27, 2014, original Chinese Version and English translation included.

(Continued)

*Primary Examiner* — Kenneth J Hansen
(74) *Attorney, Agent, or Firm* — Ladas & Parry LLP

(57) ABSTRACT

A high-pressure pump includes a pump cover, an air cylinder, a piston, a water cooling device, and a pump seat. The air cylinder is formed by a first air cylinder, a second air cylinder and a third air cylinder whose diameters are progressively reduced and that are coaxially disposed. The piston is also formed by a first piston, a second piston and a third piston whose diameters are progressively reduced and that are respectively disposed in the first air cylinder, the second air cylinder and the third air cylinder. A water cooling device is disposed between the second air cylinder and the third air cylinder.

10 Claims, 2 Drawing Sheets

(51) Int. Cl.

| | |
|---|---|
| ***F04B 39/02*** | (2006.01) |
| ***F04B 39/06*** | (2006.01) |
| ***F04B 53/04*** | (2006.01) |
| ***F04B 53/08*** | (2006.01) |
| ***F04B 53/16*** | (2006.01) |
| ***F04B 25/04*** | (2006.01) |

(52) U.S. Cl.
CPC ..... *F04B 39/0292* (2013.01); *F04B 39/064* (2013.01); *F04B 53/04* (2013.01); *F04B 53/08* (2013.01); *F04B 53/16* (2013.01)

(56) References Cited

FOREIGN PATENT DOCUMENTS

| | | | |
|---|---|---|---|
| CN | 102392808 | | 3/2012 |
| CN | 202326076 | | 7/2012 |
| CN | 202381283 | | 8/2012 |
| CN | 202381283 U | * | 8/2012 |

OTHER PUBLICATIONS

International Search Report (ISR) from State Intellectual Property Office of the People's Republic of China, mailed Oct. 27, 2014, original Chinese version and English translation included.

* cited by examiner

HIGH-PRESSURE AIR PUMP

RELATED APPLICATION

This application is a national phase entry under 35 USC 371 of International Patent Application No PCT/CN2014/074249 filed on 28 Mar. 2014, which claims priority from Chinese Patent Application No. 201410033449.8 filed on Jan. 24, 2014, the disclosures of which are incorporated in their entirety by reference herein.

FIELD OF THE INVENTION

The present invention relates to a high-pressure pump, and belongs to the manufacturing field of high-pressure pumps.

DESCRIPTION OF RELATED ART

Currently, high-pressure pumps sold on the market generally output high-pressure gas after multi-stage pressurization, but at most three-stage pressurization is performed; next, the heat dissipating manner mainly relies on natural air cooling. This type of high-pressure pump has the following main disadvantages: I) output working pressure is low and generally is not higher than 20 MP; II) the heat dissipation effect is poor, and when working, a high-pressure cavity and a high-pressure piston easily generate heat, and cannot work continuously and rapidly for a long time; III) motor driving is not suitable to be applied, a rate of pressure rise is slow, and the work efficiency is low; and IV) after the high-pressure pump is used for a long term, water in high-pressure air is gathered in a pump body, and it is required to remove the water in the pump.

SUMMARY OF THE INVENTION

Technical Problem

In order to overcome the disadvantages in the existing high-pressure pump, the present invention provides a high-pressure pump.

Technical Solution

Specific technical solutions of the present invention are as follows: A high-pressure pump includes a pump cover, an air cylinder, a piston, a water cooling device, and a pump seat. The air cylinder is formed by a first air cylinder, a second air cylinder and a third air cylinder whose diameters are progressively reduced and that are coaxially disposed. The piston is also formed by a first piston, a second piston and a third piston whose diameters are progressively reduced and that are respectively disposed in the first air cylinder, the second air cylinder and the third air cylinder. A water cooling device is disposed between the second air cylinder and the third air cylinder. An upper end of the first air cylinder is connected and fixed to the pump cover, and a lower end is connected and fixed to the pump seat. The second air cylinder is fixed on the first piston. An upper end of the third air cylinder is also fixed on the pump cover, and a lower end is connected and fixed to the second piston. A first water inlet through hole and a second water outlet through hole are disposed on the pump cover, and an inlet and an outlet of the first through hole and the second through hole are respectively provided with a joint for installing an inlet conduit and an outlet conduit. The water cooling device is formed by a cooling water groove and a water inlet conduit, a conduit is disposed at one side of the water groove, a water outlet is disposed at the other side of the water groove, and a water inlet of the conduit and the water outlet of the water groove are respectively connected to the first water inlet through hole and the second water outlet through hole of the pump cover. The high-pressure pump further includes a water cooling detection system, where the first water inlet through hole is connected in series to a water flow sensor at the joint through a pipe, and the water flow sensor is used for monitoring a water flow rate in the first water inlet through hole; and an automatic lubrication system. The first piston is formed by connecting, by using a connecting rod, an upper piston and a lower piston, a second one-way inlet valve of a second-stage pressurization cavity is disposed on the lower piston, and a connecting plate with a linkage shaft is disposed below the lower piston. An open type guide ring is disposed between the upper piston and the first air cylinder, a guide ring and a seal ring are disposed between the lower piston and the first air cylinder, and through sealing of the seal ring, an oil storage tank is formed by a cavity enclosed by the connecting rod, the upper piston, the lower piston and the first air cylinder. An oil window is further disposed on the first air cylinder, and when the piston works upwards, an oil level reaches the oil window, and lubricating oil enters the oil window; an oil storage groove is disposed on an upper side surface of the upper piston, and when the piston works downwards, oil in the oil window flows, from being temporarily sealed by the open type guide ring, into the oil storage groove. After stored oil exceeds the oil storage groove, excessive oil flows into the oil storage tank through an opening of the open type guide ring, and the lubricating oil slowly permeates into the air cylinder through the seal ring under the oil storage groove for lubrication.

The high-pressure pump further includes an automatic drainage system. A vent is further disposed on the pump cover, and the vent is a high-pressure output one-way valve. A pump output port is disposed at one side of the high-pressure output one-way valve, the pump output port is connected to a filter by using a high-pressure pipe, high-pressure gas enters the filter through a high-pressure gas pipe, and a high-pressure gas output port is disposed at an upper end of the filter. Water drops are generated by the gas through filtering of glass beads, and water is accumulated at the bottom of the filter after long time work. A drainage device is disposed at the bottom of the filter, and an electromagnet controls opening and closing of the drainage device. A regulation timer is further connected to the electromagnet.

The second piston is formed by a piston A with a first piston ring and a piston B with a second piston ring. A gas storage cavity in communication with the cavity of the third air cylinder is disposed between the piston A and the piston B. A third through hole is disposed on the piston A. The second piston ring and the piston B form a third one-way inlet valve of a third-stage pressurization cavity.

The third piston is formed by a piston rod and a high-pressure piston with a third piston ring and a fourth through hole. A lower end of the piston rod is fixed on the lower piston of the first piston, and an upper end is connected to a high-pressure piston ring. The third piston ring and the high-pressure piston form a fourth one-way inlet valve of a fourth-stage pressurization cavity.

The pump seat is a box body of a crankcase, and a fifth through hole is disposed on an upper cover thereof.

A first-stage pressurization cavity is formed by an inner cavity of the first air cylinder and an inner cavity of the box body of the crankcase.

The second-stage pressurization cavity is a cavity enclosed, in an inner cavity of the second air cylinder, by the lower piston of the first piston and a piston B of the second piston.

The third-stage pressurization cavity is a cavity enclosed, in an inner cavity of the third air cylinder, by a high-pressure piston and an inner wall of the pump cover.

The fourth-stage pressurization cavity is a cavity enclosed, in an inner cavity of the third air cylinder, by the high-pressure piston and an inner wall of the pump cover.

The cooling water groove is formed by a bottomless barrel and an outer wall of the third air cylinder, an upper end of the bottomless barrel is fixed on the pump cover, and a lower end is connected and fixed to a piston A of the second piston.

The crankcase is formed by the box body and a crank mechanism, one end of the crank mechanism is connected to a linkage shaft mounted on a lower piston connecting plate of the first piston, and the other end is connected to a matched traction device.

Advantageous Effect

The present invention has the following advantages: I) output working pressure is high; II) a heat dissipation structure is designed, the heat dissipation effect is good, and the high-pressure pump can work continuously and rapidly for a long time; III) motor driving is suitable to be applied, a rate of pressure rise is fast, and the work efficiency is high; and IV) a device for filtering water in the air is disposed, and after long-term use, it is not required to remove water in the pump.

BRIEF DESCRIPTION OF THE DRAWINGS

The following further describes the present invention with reference to the accompanying drawings and the embodiments.

1. Pump cover; 2. air cylinder; 3. piston; 4. water cooling device; 5. pump seat; 6. traction device; 11. first through hole; 12. second through hole; 13. joint; 14. high-pressure one-way valve; 21. first air cylinder; 22. second air cylinder; 23. third air cylinder; 211. first-stage pressurization cavity; 221. second-stage pressurization cavity; 222. third-stage pressurization cavity; 231. fourth-stage pressurization cavity; 31. first piston; 33. third piston; 311. upper piston; 312. lower piston; 313. connecting rod; 314. second inlet valve; 315. connecting plate; 316. linkage shaft; 321. first piston ring; 322. piston A; 323. second piston ring; 324. piston B; 325. gas storage cavity; 326. third through hole; 327. third inlet valve; 331. piston rod; 332. third piston ring; 333. high-pressure piston; 334. fourth inlet valve; 335. fourth through hole; 41. water groove; 42. conduit; 43. water outlet; 44. bottomless barrel; 401. water flow switch; 402. oil window; 403. oil storage tank; 404. seal ring; 405. guide ring; 406. open type guide ring; 407. high-pressure gas pipe; 408. glass bead; 409. filter; 410. electromagnet; 411. drainage device; 51. crankcase; 52. box body; 53. fifth through hole; 54. filter screen; 55. first inlet valve; and 56. crank mechanism

DETAILED DESCRIPTION OF THE INVENTION

Figure 1:
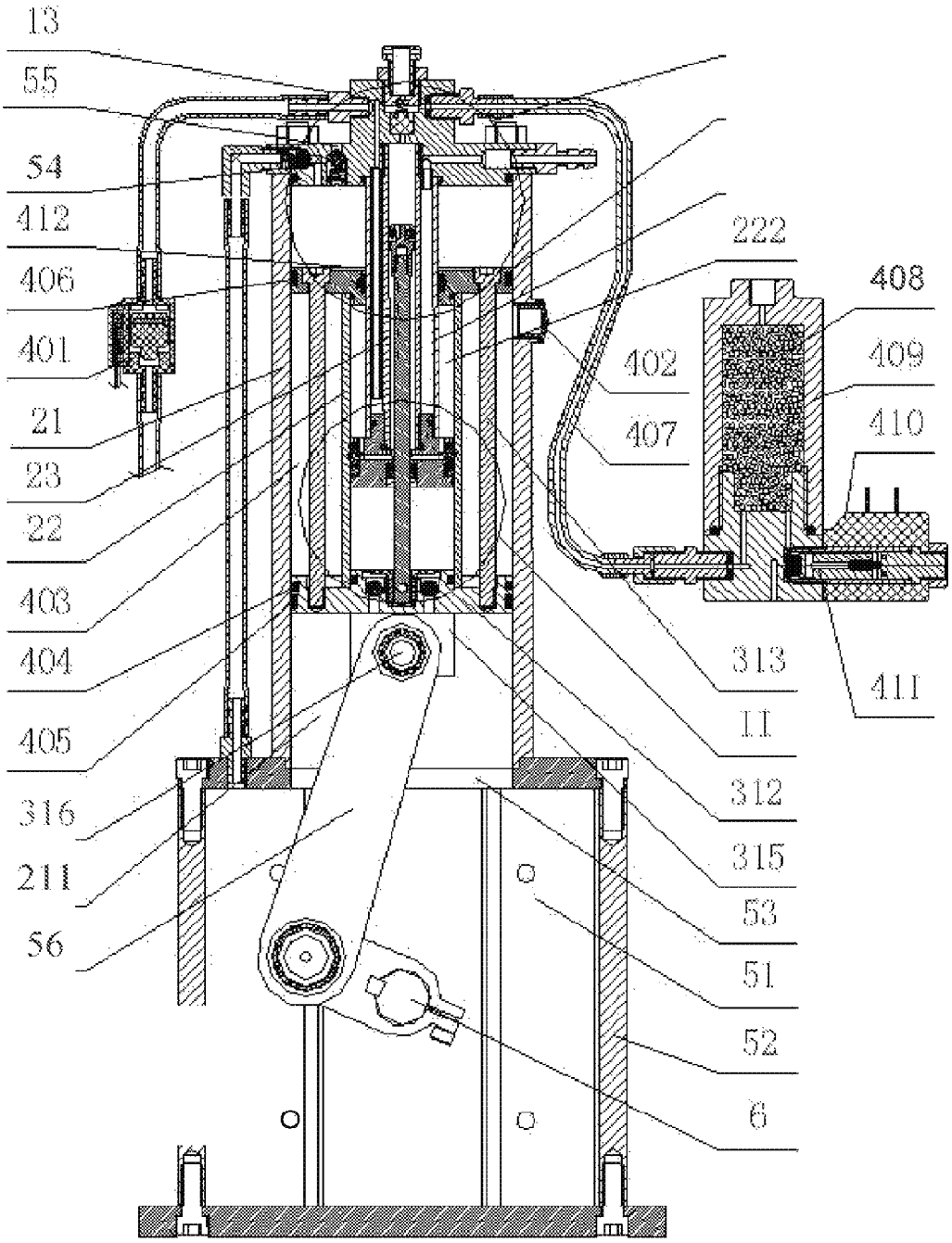
FIG. 1 is an overall structural view of the present invention.
Figure 2:
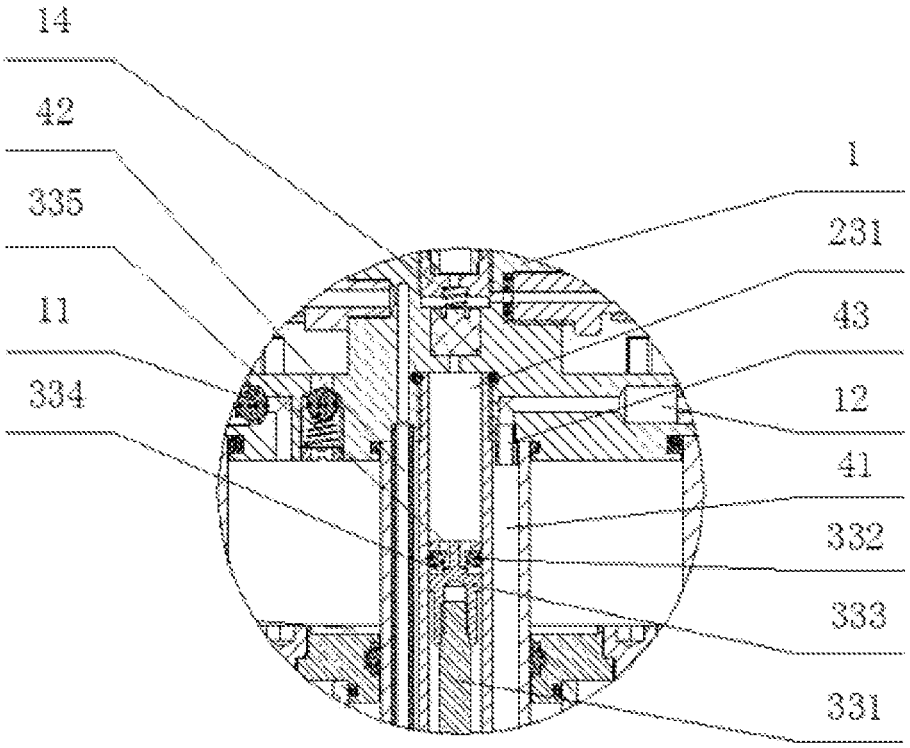
FIG. 2 is a partial enlarged view of I in FIG. 1.
Figure 3:
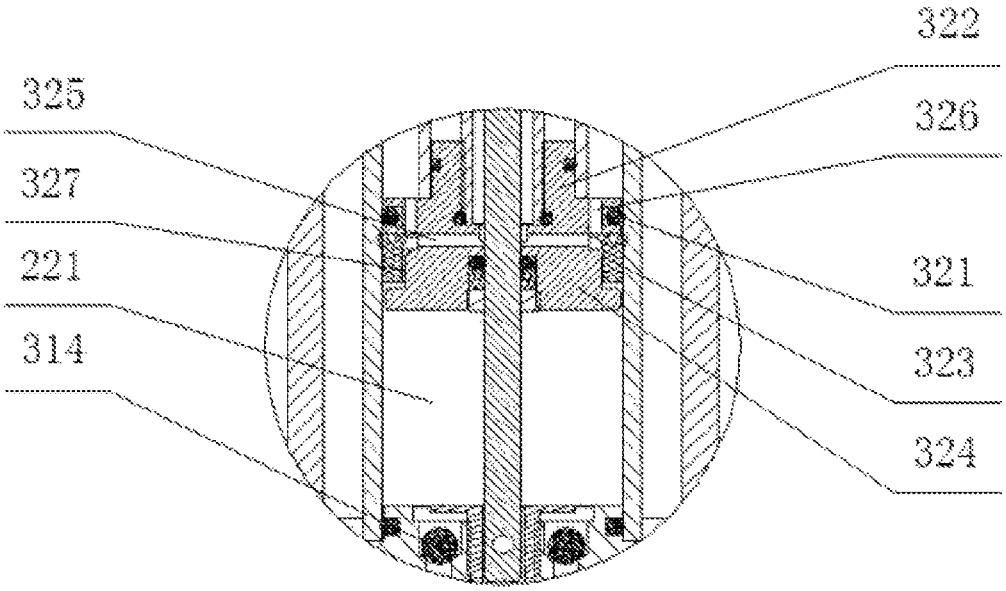
FIG. 3 is a partial enlarged view of II in FIG. 1.

As shown in FIG. 1, FIG. 2 and FIG. 3, a high-pressure pump includes a pump cover 1, an air cylinder 2, a piston 3, a water cooling device 4, and a pump seat 5. The air cylinder is formed by a first air cylinder 21, a second air cylinder 22 and a third air cylinder 23 whose diameters are progressively reduced and that are coaxially disposed. The piston 3 is also formed by a first piston 31, a second piston and a third piston 33 whose diameters are progressively reduced and that are respectively disposed in the first air cylinder 21, the second air cylinder 22 and the third air cylinder 23. A water cooling device 4 is disposed between the second air cylinder 22 and the third air cylinder 23. An upper end of the first air cylinder 21 is connected and fixed to the pump cover 1, and a lower end is connected and fixed to the pump seat 5. The second air cylinder 22 is fixed on the first piston 31. An upper end of the third air cylinder 23 is also fixed on the pump cover 1; and a lower end is connected and fixed to the second piston. A first water inlet through hole and a second water outlet through hole are disposed on the pump cover 1, and an inlet and an outlet of the first through hole 11 and the second through hole 12 are respectively provided with a joint 13 for installing an inlet conduit and an outlet conduit. The water cooling device 4 is formed by a cooling water groove 41 and a water inlet conduit, a conduit 42 is disposed at one side of the water groove 41, a water outlet 43 is disposed at the other side of the water groove 41, and a water inlet of the conduit and the water outlet 43 of the water groove 41 are respectively connected to the first water inlet through hole and the second water outlet through hole of the pump cover 1. The high-pressure pump further includes a water cooling detection system. The first water inlet through hole is connected in series to a water flow sensor at the joint 13 through a pipe, and the water flow sensor is used for monitoring a water flow rate in the first water inlet through hole.

The high-pressure pump further includes an automatic lubrication system. The first piston 31 is formed by connecting, by using a connecting rod 313, an upper piston 311 and a lower piston 312, a second one-way inlet valve 314 of a second-stage pressurization cavity 221 is disposed on the lower piston 312, and a connecting plate 315 with a linkage shaft 316 is disposed below the lower piston 312. An open type guide ring 406 is disposed between the upper piston 311 and the first air cylinder 21, a guide ring 405 and a seal ring 404 are disposed between the lower piston 312 and the first air cylinder 21, and through sealing of the seal ring 404, an oil storage tank 403 is formed by a cavity enclosed by the connecting rod 313, the upper piston 311, the lower piston 312 and the first air cylinder 21, An oil window 402 is further disposed on the first air cylinder 21, and when the piston 3 works upwards, an oil level reaches the oil window 402, and lubricating oil enters the oil window 402. An oil storage groove is disposed on an upper side surface of the upper piston 311, and when the piston 3 works downwards, oil in the oil window 402 flows, from being temporarily sealed by the open type guide ring 406, into the oil storage groove. After stored oil exceeds the oil storage groove, excessive oil flows into the oil storage tank 403 through an opening of the open type guide ring 406, and the lubricating oil slowly permeates into the air cylinder 2 through the seal ring 404 under the oil, storage groove for lubrication.

The high-pressure pump further includes an automatic drainage system. A vent is further disposed on the pump cover 1, and the vent is a high-pressure output one-way valve 14. A pump output port is disposed at one side of the high-pressure output one-way valve 14, the pump output port is connected to a filter 409 by using a high-pressure pipe, high-pressure gas enters the filter 409 through a high-pressure gas pipe 407, and a high-pressure gas output port is disposed at an upper end of the filter 409. Water drops are generated by the gas through filtering of glass beads 408, and water is accumulated at the bottom of the filter 409 after tong time work. A drainage device 411 is disposed at the bottom of the filter, and an electromagnet 410 controls opening and closing of the drainage device 411. A regulation timer is further connected to the electromagnet 410.

The second piston is formed by a piston A 322 with a first piston ring 321 and a piston B 324 with a second piston ring 323. A gas storage cavity 325 in communication with the cavity of the third air cylinder 23 is disposed between the piston A 322 and the piston B 324. A third through hole 326 is disposed on the piston A 322, The second piston ring 323 and the piston B 324 form a third one-way inlet valve 327 of a third-stage pressurization cavity 222.

The third piston 33 is formed by a piston rod 331 and a high-pressure piston 333 with a third piston ring 332 and a fourth through hole 335, A lower end of the piston rod 331 is fixed on the lower piston 312 of the first piston 31, and an upper end is connected to a high-pressure piston ring. The third piston ring 332 and the high-pressure piston 333 form a fourth one-way inlet valve 334 of a fourth-stage pressurization cavity 231.

The pump seat 5 is a box body 52 of a crankcase 51, and a fifth through hole 53 is disposed on an upper cover thereof.

A first-stage pressurization cavity 211 is formed by an inner cavity of the first air cylinder 21 and an inner cavity of the box body 52 of the crankcase 51.

The second-stage pressurization cavity 221 is a cavity enclosed, in an inner cavity of the second air cylinder 22, by the lower piston 312 of the first piston 31 and a piston B 324 of the second piston.

The third-stage pressurization cavity 222 is a cavity enclosed, in an inner cavity of the third air cylinder 23, by a high-pressure piston 333 and an inner wall of the pump cover 1.

The fourth-stage pressurization cavity 231 is a cavity enclosed, in an inner cavity of the third air cylinder 23, by the high-pressure piston 333 and an inner wall of the pump cover 1.

The cooling water groove 41 is formed by a bottomless barrel 44 and an outer wall of the third air cylinder 23, an upper end of the bottomless barrel 44 is fixed on the pump cover 1, and a lower end is connected and fixed to a piston A 322 of the second piston.

The crankcase 51 is formed by the box body 52 and a crank mechanism 56, one end of the crank mechanism 56 is connected to a linkage shaft 316 mounted on a lower piston connecting plate 315 of the first piston 31, and the other end is connected to a matched traction device 6.

I) Output working pressure is high; II) a heat dissipation structure is designed, the heat dissipation effect is good, and the high-pressure pump can work continuously and rapidly for a long time; III) motor driving is suitable to be applied, a rate of pressure rise is fast, and the work efficiency is high; and IV) a device for filtering water in the air is disposed, and after long-term use, it is not required to remove water in the pump.

What is claimed is:

1. A high-pressure pump, comprising a pump cover, an air cylinder, a piston, a water cooling device, and a pump seat, wherein the air cylinder is formed by a first air cylinder, a second air cylinder and a third air cylinder, each cylinder has a diameter with each diameter of the first, second, and third cylinders being reduced with respect to the other and that are coaxially disposed; the piston is also formed by a first piston, a second piston and a third piston whose diameters are progressively reduced and that are respectively disposed in the first air cylinder, the second air cylinder and the third air cylinder; a water cooling device is disposed between the second air cylinder and the third air cylinder; an upper end of the first air cylinder is connected and fixed to the pump cover, and a lower end is connected and fixed to the pump seat; the second air cylinder is fixed on the first piston; an upper end of the third air cylinder is also fixed on the pump cover, and a lower end is connected and fixed to the second piston; a first water inlet through hole and a second water outlet through hole are disposed on the pump cover, and an inlet and an outlet of the first through hole and the second through hole are respectively provided with a joint for installing an inlet conduit and an outlet conduit; the water cooling device is formed by a cooling water groove and a water inlet conduit, a conduit is disposed at one side of the water groove, a water outlet is disposed at the other side of the water groove, and a water inlet of the conduit and the water outlet of the water groove are respectively connected to the first water inlet through hole and the second water outlet through hole of the pump cover; and further comprising: a water cooling detection system, wherein the first water inlet through hole is connected in series to a water flow switch at the joint through a pipe, when a water flow passes through the water flow switch, the water flow switch is in a normally closed state, and when the water flow is in a cut-off state, the water flow switch is in a normally open state; an automatic lubrication system, wherein the first piston is formed by connecting, by using a connecting rod, an upper piston and a lower piston, a second one-way inlet valve of a second-stage pressurization cavity is disposed on the lower piston, and a connecting plate with a linkage shaft is disposed below the lower piston; an open guide ring provided with an opening, through which stored oil exceeding an oil storage groove flows into an oil storage tank, is disposed between the upper piston and the first air cylinder, a guide ring and a seal ring are disposed between the lower piston and the first air cylinder, and through sealing of the seal ring, the oil storage tank is formed by a cavity enclosed by the connecting rod, the upper piston, the lower piston and the first air cylinder; an oil window is further disposed on the first air cylinder, and when the piston works upwards, an oil level reaches the oil window, and lubricating oil enters the oil window; the oil storage groove is disposed on an upper side surface of the upper piston, and when the piston works downwards, oil in the oil window flows, from being temporarily sealed by the open guide ring, into the oil storage groove; after stored oil exceeds the oil storage groove, excessive oil flows into the oil storage tank through the opening of the open guide ring, and the lubricating oil slowly permeates into the air cylinder through the seal ring under the oil storage groove for lubrication; an automatic drainage system, wherein a vent is further disposed on the pump cover, and the vent is a high-pressure output one-way valve; a pump output port is disposed at one side of the high-pressure output one-way valve, the pump output port is connected to a filter by using a high-pressure pipe, high-pressure gas enters the filter through a high-pressure gas pipe, and a high-pressure gas output port is disposed at an upper end of the filter; water drops are generated by the gas through filtering of glass beads, and water is accumulated at the bottom of the filter; a drainage device is disposed at the bottom of the filter, and an electromagnet controls opening and closing of the drainage device; a regulation timer is further connected to the electromagnet.

2. The high-pressure pump according to claim 1, wherein the second piston is formed by a piston A with a first piston ring and a piston B with a second piston ring, a gas storage cavity in communication with a cavity of the third air cylinder is disposed between the piston A and the piston B, a third through hole is disposed on the piston A, and the second piston ring and the piston B form a third one-way inlet valve of a third-stage pressurization cavity.

3. The high-pressure pump according to claim 2, wherein the third-stage pressurization cavity is a cavity enclosed, in an inner cavity of the third air cylinder, by a high-pressure piston and an inner wall of the pump cover.

4. The high-pressure pump according to claim 1, wherein the third piston is formed by a piston rod and a high-pressure piston with a third piston ring and a fourth through hole; a lower end of the piston rod is fixed on the lower piston of the first piston, and an upper end is connected to a high-pressure piston ring; and the third piston ring and the high-pressure piston form a fourth one-way inlet valve of a fourth-stage pressurization cavity.

5. The high-pressure pump according to claim 4, wherein the fourth-stage pressurization cavity is a cavity enclosed, in an inner cavity of the third air cylinder, by the high-pressure piston and an inner wall of the pump cover.

6. The high-pressure pump according to claim 1, wherein the pump seat is a box body of a crankcase, and a fifth through hole is disposed on an upper cover of the pump seat.

7. The high-pressure pump according to claim 6, wherein the crankcase is formed by the box body and a crank mechanism, one end of the crank mechanism is connected to a linkage shaft mounted on the connecting plate disposed below the lower piston of the first piston, and the other end is connected to a matched traction device.

8. The high-pressure pump according to claim 6, wherein a first-stage pressurization cavity is formed by an inner cavity of the first air cylinder and an inner cavity of the box body of the crankcase.

9. The high-pressure pump according to claim 1, wherein the second-stage pressurization cavity is a cavity enclosed, in an inner cavity of the second air cylinder, by the lower piston of the first piston and a piston B of the second piston.

10. The high-pressure pump according to claim 1, wherein the cooling water groove is formed by a barrel having an open top and an open bottom and an outer wall of the third air cylinder, and wherein the open top of the barrel is fixed on the pump cover, and the open bottom is connected and fixed to a piston A of the second piston.

* * * * *